US007073665B2

(12) United States Patent
Auclair et al.

(10) Patent No.: US 7,073,665 B2
(45) Date of Patent: Jul. 11, 2006

(54) DISPENSER WITH DETACHABLE RETENTION FEATURE

(75) Inventors: Jean-Michel Auclair, Chateauroux (FR); Patrick Blin, Chateauroux (FR); Aaron Bates, Powder Springs, GA (US); Erica Watson, Smyrna, GA (US)

(73) Assignee: MeadWestvaco Packaging Systems LLC, Stamford, CT (US)

( * ) Notice: Subject to any disclaimer, the term of this patent is extended or adjusted under 35 U.S.C. 154(b) by 0 days.

(21) Appl. No.: 10/717,254

(22) Filed: Nov. 19, 2003

(65) Prior Publication Data

US 2005/0103650 A1 May 19, 2005

(51) Int. Cl.

| | |
|---|---|
| ***B65D 75/00*** | (2006.01) |
| ***B65D 5/72*** | (2006.01) |
| ***B65D 17/28*** | (2006.01) |
| ***A47F 1/04*** | (2006.01) |

(52) U.S. Cl. ..... 206/427; 221/305; 221/309; 229/122; 229/240

(58) Field of Classification Search ..... 206/427, 206/430; 221/303–305, 309; 229/122–122.1, 229/240, 121

See application file for complete search history.

(56) References Cited

U.S. PATENT DOCUMENTS

| | | | | |
|---|---|---|---|---|
| 3,178,242 | A | 4/1965 | Ellis et al. | |
| 3,237,837 | A * | 3/1966 | Vizethann | 229/240 |
| 3,263,861 | A * | 8/1966 | Carr | 221/305 |
| 3,265,283 | A * | 8/1966 | Farquhar | 206/427 |
| 3,356,279 | A | 12/1967 | Root | |
| 3,416,719 | A | 12/1968 | Pilger | |
| 3,653,495 | A | 4/1972 | Gray | |
| 4,340,170 | A | 7/1982 | Montealegre | |
| D270,041 | S | 8/1983 | Vestal | |
| 4,396,143 | A * | 8/1983 | Killy | 221/305 |
| 4,417,661 | A | 11/1983 | Roccaforte | |
| 5,505,372 | A | 4/1996 | Edson et al. | |
| 5,622,309 | A | 4/1997 | Matsuda et al. | |
| 5,927,498 | A | 7/1999 | Saam | |
| 6,283,293 | B1 * | 9/2001 | Lingamfelter | 206/427 |
| 6,484,903 | B1 * | 11/2002 | Spivey et al. | 221/303 |
| 6,550,615 | B1 * | 4/2003 | Lingamfelter | 206/427 |
| 6,578,736 | B1 * | 6/2003 | Spivey | 221/305 |
| 6,715,639 | B1 * | 4/2004 | Spivey | 221/305 |
| 6,789,673 | B1 * | 9/2004 | Lingamfelter | 206/427 |

(Continued)

FOREIGN PATENT DOCUMENTS

| | | |
|---|---|---|
| EP | 0 203 806 A2 | 12/1986 |

*Primary Examiner*—Bryon P. Gehman
(74) *Attorney, Agent, or Firm*—Tsugihiko Suzuki, MWV; Parks Knowlton LLC; Cynthia R. Parks, Esq.

(57) ABSTRACT

A carton for dispensing articles having a dispensing feature is adapted for restraining articles within the carton until the consumer desires to remove the endmost articles from the carton. To erect the carton, a plurality of panels are connected together to define an end of the carton. A first detachable portion at the end of the carton may be detached from the carton to define an opening for dispensing articles from an upper or lower row of articles within the carton. A second detachable portion at the end of the carton borders the first detachable portion and may also be detached from the carton to enlarge the opening in an alternative embodiment. The second detachable portion restrains articles in an upper row of articles prior to detaching the second detachable portion from the erected carton.

9 Claims, 12 Drawing Sheets

U.S. PATENT DOCUMENTS 6,866,188 B1 * 3/2005 Harrelson ..... 229/121
2004/0089671 A1 * 5/2004 Miller ..... 221/305
2004/0164133 A1 8/2004 Harrelson
2004/0164136 A1 8/2004 Harrelson
2004/0188300 A1 * 9/2004 Sutherland ..... 206/427
2004/0232214 A1 * 11/2004 Bates ..... 229/122.1

* cited by examiner

DISPENSER WITH DETACHABLE RETENTION FEATURE

TECHNICAL FIELD

The present invention relates generally to paperboard cartons for use in packaging articles and, more particularly, relates to a dispensing carton with an opening for dispensing and restraining articles as desired within the carton.

BACKGROUND OF THE INVENTION

Cartons are useful for allowing consumers to purchase, transport and store a desired quantity of articles such as soft drinks. For the convenience of the consumer, some cartons have dispensers which allow the articles to be removed one at a time while continuing to encase the remaining articles. A portion of the carton is torn out to form an opening from which articles may be dispensed.

Unfortunately, more than one article is often dispensed at a time through the opening which leads to many of the articles being dispensed onto the floor. This is because the articles to remain within the opened carton are not sufficiently restrained by the carton.

For example, there are typically multiple rows or tiers of articles, one above the other, carried within the carton. Once the endmost article of a lower row of articles is removed from the carton through the dispenser, another article from the upper row of articles unexpectedly falls forward and out through the dispenser. Therefore, there is a need for a carton having an improved dispenser that facilitates easy access to the endmost article in the lower row of articles while also sufficiently restraining the articles in the upper row until it is desirable to dispense articles from the upper row.

SUMMARY OF THE INVENTION

The present invention provides a carton with a dispenser having multiple detachable portions which border one another at one end of the carton. The detachable portions may be separately detached from the carton to variably define an opening for dispensing articles as well as restrain the remaining articles within the carton.

Generally described, a plurality of panels are connected together to form the carton of the present invention. A first detachable portion at the end of the carton may be detached from the carton to define an opening for dispensing articles from an upper or lower row of articles within the carton. Detachment of the first detachable portion defines a lower edge of the carton about the periphery of the opening for restraining the lower row of articles. Detachment of the first detachable portion also defines an upper edge of the opening on the carton end for restraining the upper row of articles within the carton.

According to one aspect of the present invention, a second detachable portion at the end of the carton borders above the first detachable portion. The second detachable portion restrains articles in the upper row of articles prior to being detached from the carton. An edge of the second detachable portion when attached to the carton prevents the endmost article of the upper row from falling through the dispenser after one of the articles from the upper or lower row has been removed. The second detachable portion may be at least partially detached from the carton to redefine the opening for dispensing articles from the upper row of articles. Detachment of the second detachable portion from the carton broadens the opening by redefining the upper edge of the opening to no longer restrain the upper row of articles.

According to another aspect of the present invention, the carton is formed from a blank having frangible lines at one end of the blank for defining the first detachable portion which extends from the distal end of each of the end flaps of the opposing side panels. Each frangible line extends from its respective end flap onto one of the side panels and then turns back on the side panel to terminate on the distal end of the end flap from which it originated. The frangible lines cooperate with one another when the carton is erected and the end flaps are folded together to define the first detachable portion.

According to yet another aspect of the present invention, another frangible line extends between the two side panels and across a top panel of the blank to partially define the second detachable portion. End portions of the frangible line terminate on the opposing side panels such that the second detachable portion is defined by portions of the opposing side panels, portions of the end flaps, and a portion of the top panel.

The foregoing has broadly outlined some of the more pertinent aspects and features of the present invention. These should be construed to be merely illustrative or some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 1:
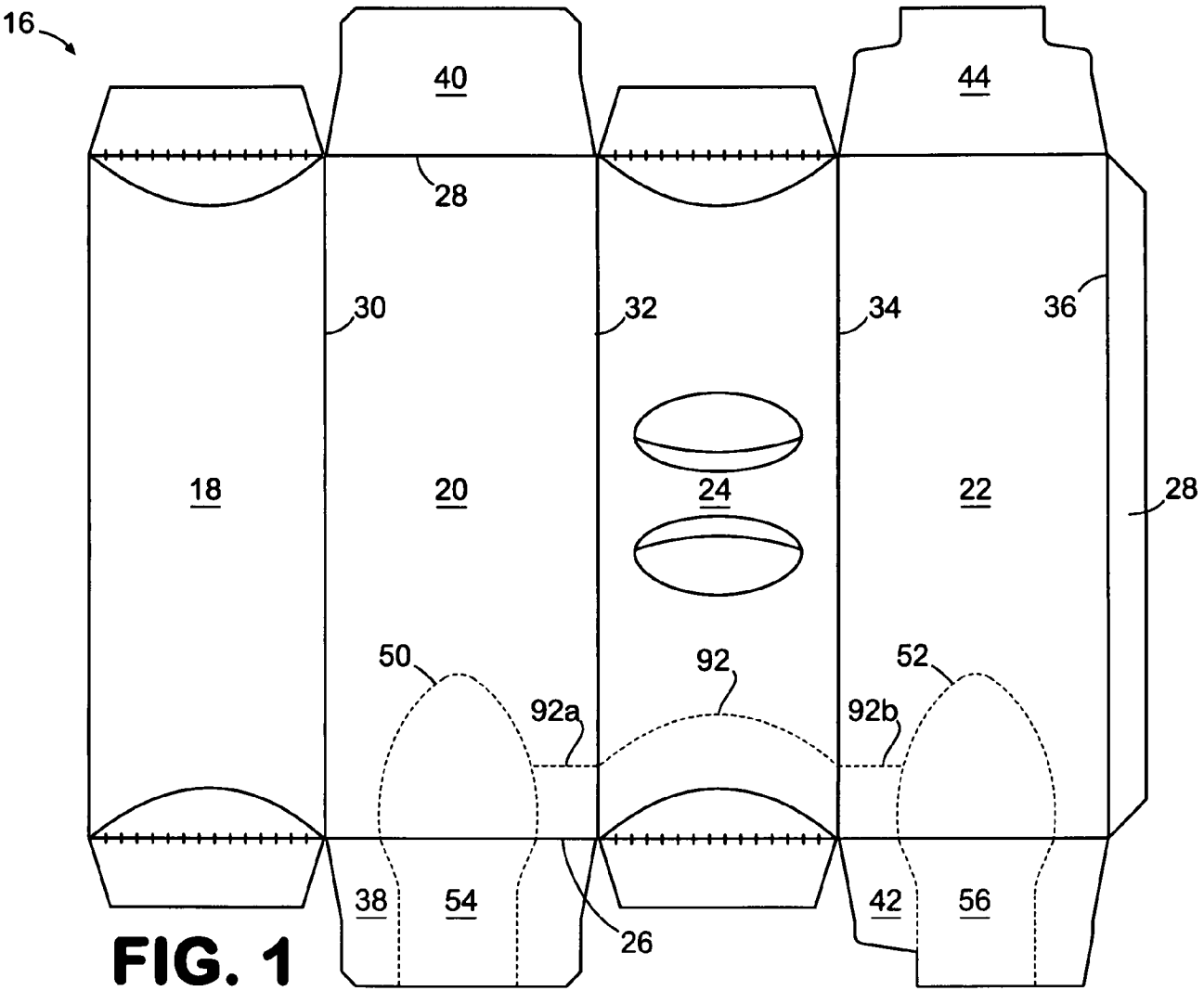
FIG. 1 illustrates a plan view of one embodiment of a blank for forming the carton of the present invention.

Referring now to the drawings in which like minerals indicate like elements throughout the several views, the drawings illustrate exemplary embodiments of cartons 10 (FIG. 3), 12 (FIG. 6), and 14 (FIG. 9) of the present invention. In one embodiment, the cartons 10, 12 and 14 are cartons for dispensing articles such as beverage cans.

Generally described, the cartons 10, 12 and 14 are formed from a foldable sheet material such as a paperboard blank. Carton 10 is formed from a paperboard blank 16 configured as shown in FIG. 1. The blank 16 includes at least four primary panels for forming the carton 10. The panels of the blank 16 are a bottom panel 18, a first side panel 20, a second side panel 22, and a top panel 24. As shown in FIG. 1, the panels of the blank 16 are hingedly connected in series to one another. The bottom panel 18 is hingedly connected to the first side panel 20 by fold line 30. The first side panel 20 is then hingedly connected to the top panel 24 by fold line 32. The second side panel 22 is then hingedly connected to the top panel 24 by fold line 34.

Each of the panels 18, 20, 22 and 24 includes opposing end flaps defined by transverse fold lines 26 and 28. Fold lines 26 and 28 each extend the full length of the blank 16. First side panel 20 includes opposing end flaps 38 and 40 and second side panel 22 includes opposing end flaps 42 and 44. In order to erect the carton 10, bottom panel 18 is glued or is otherwise secured to side panel 22 by edge flap 28, hingedly connected to second side panel 22 by fold line 36, to form an open ended tubular carton 10. After the articles are grouped and loaded through either or both of the open ends of the carton 10, the end flaps are folded and secured together to form opposed end closure structures of the carton 10. End flap 40 is secured to end flap 44 whereas end flap 38 is secured to end flap 42.

The cartons illustrated in the drawings are adapted to hold a group of similarly dimensioned, cylindrical articles (such as cans or bottles), in a plurality of vertically arranged rows. For example, two rows R are shown in FIGS. 9–12, the articles in each row being disposed horizontally with respect to one another, with an upper row being disposed vertically with respect to a lower row. Adjacent articles in adjacent rows are disposed vertically with respect to one another approximating columns C, also shown in FIGS. 9 and 10. The articles in each row are disposed on their sides in a side-by-side parallel fashion. The side panels 20 and 22 are disposed alongside the ends of the articles of the group while each end closure structure of the carton is disposed adjacent to the side walls of the respective endmost articles. Thus, each end closure structure is adjacent to an endmost column of articles, each endmost column comprising the endmost article in each row.

Figure 2:
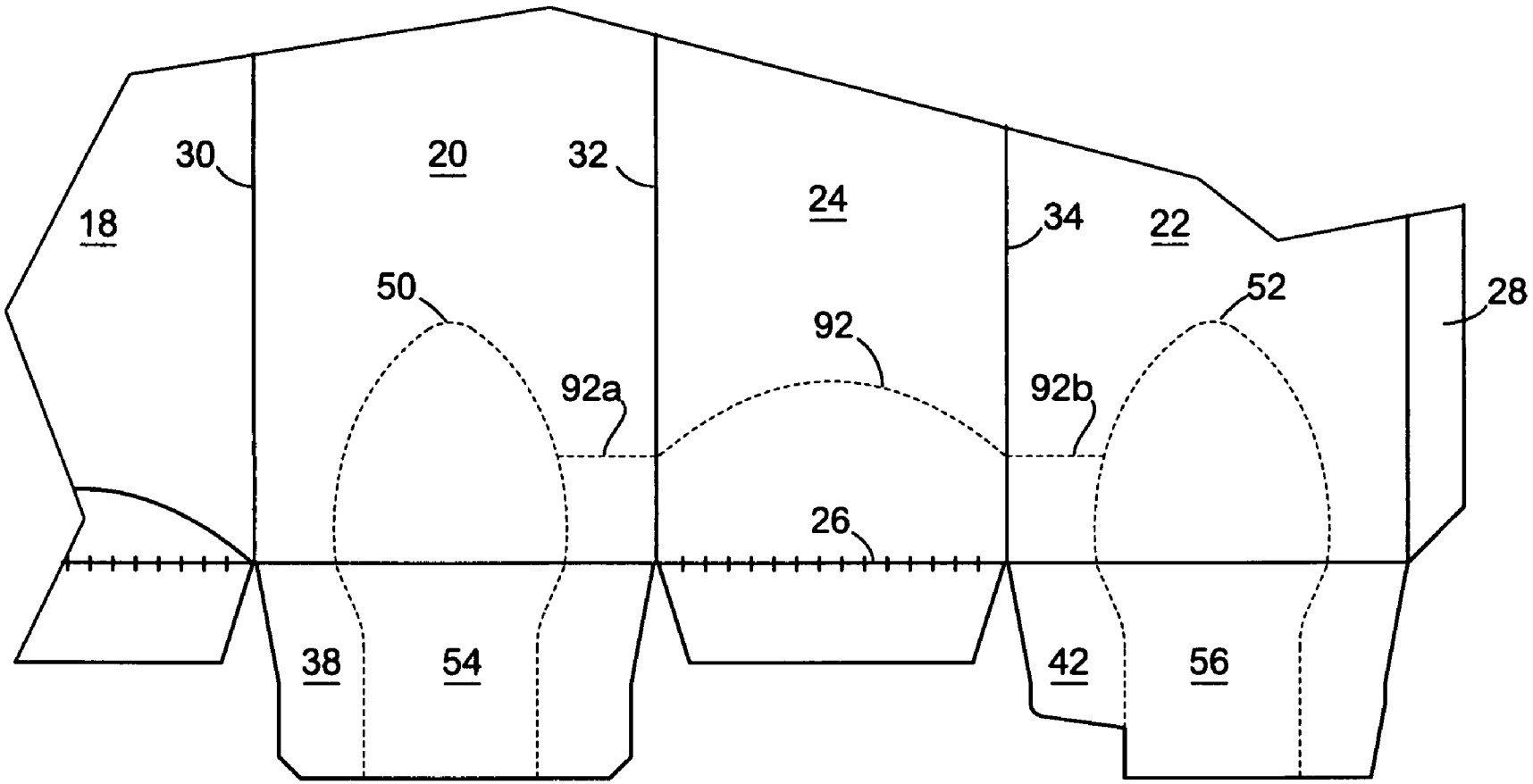
FIG. 2 is an enlarged fragmentary plan view of the blank of FIG. 1.

As best shown in FIG. 2, the blank 16 includes frangible lines 50 and 52 which define portions 54 and 56, respectively. The frangible lines 50, 52 may be a line of severance or any other weakened line that facilitates separation along the frangible lines 50, 52. It is contemplated that frangible lines include, but are not limited to, lines of perforation, lines of short slits, lines of nick members, or the equivalent.

Portions 54 and 56 are similarly configured relative to one another. To define portions 54 and 56, the frangible lines 50 and 52 each extend from the distal end of end flaps 38 and 42, respectively. Each frangible line 50, 52 extends across fold line 26 onto the respective one of the side panels 20, 22 and then terms back around on the respective side panel to terminate on the distal end of the end flap from which it originated. Therefore, each frangible line 50, 52 is intersected twice by fold line 26.

Figure 3:
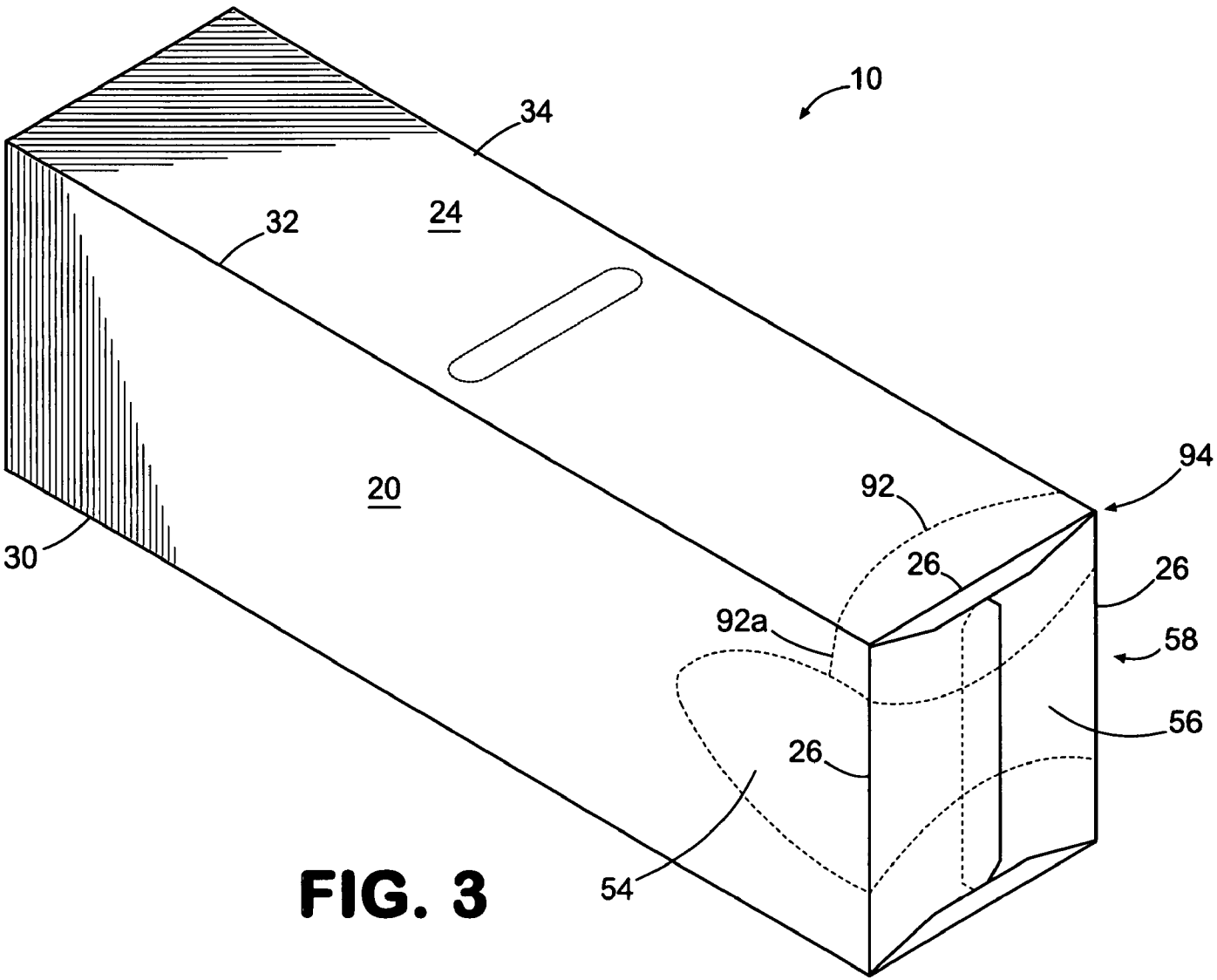
FIG. 3 is a perspective view of a carton of the present invention formed from the blank of FIG. 1.

Portions of the frangible lines 50, 52 across end (laps 38, 42 and adjacent fold line 26 are preferably arched somewhat inward relative to one another so that the portions 54 and 56 are narrowest at the distal ends of end flaps 38 and 42. Also, each of the portions 54 and 56 on the side panels 20 and 22 preferably are essentially triangular-shaped as best shown in FIG. 2. When the carton 10 is erected and end flaps 38 and 42 are folded and secured to one another, portions 54 and 56 cooperate with one another along frangible lines 50, 52 to define a first detachable portion 58 as shown in FIG. 3. The frangible lines 50, 52 combine to define a continuous or endless frangible line about the periphery of the first detachable portion 58 of the carton 10.

Figure 4:
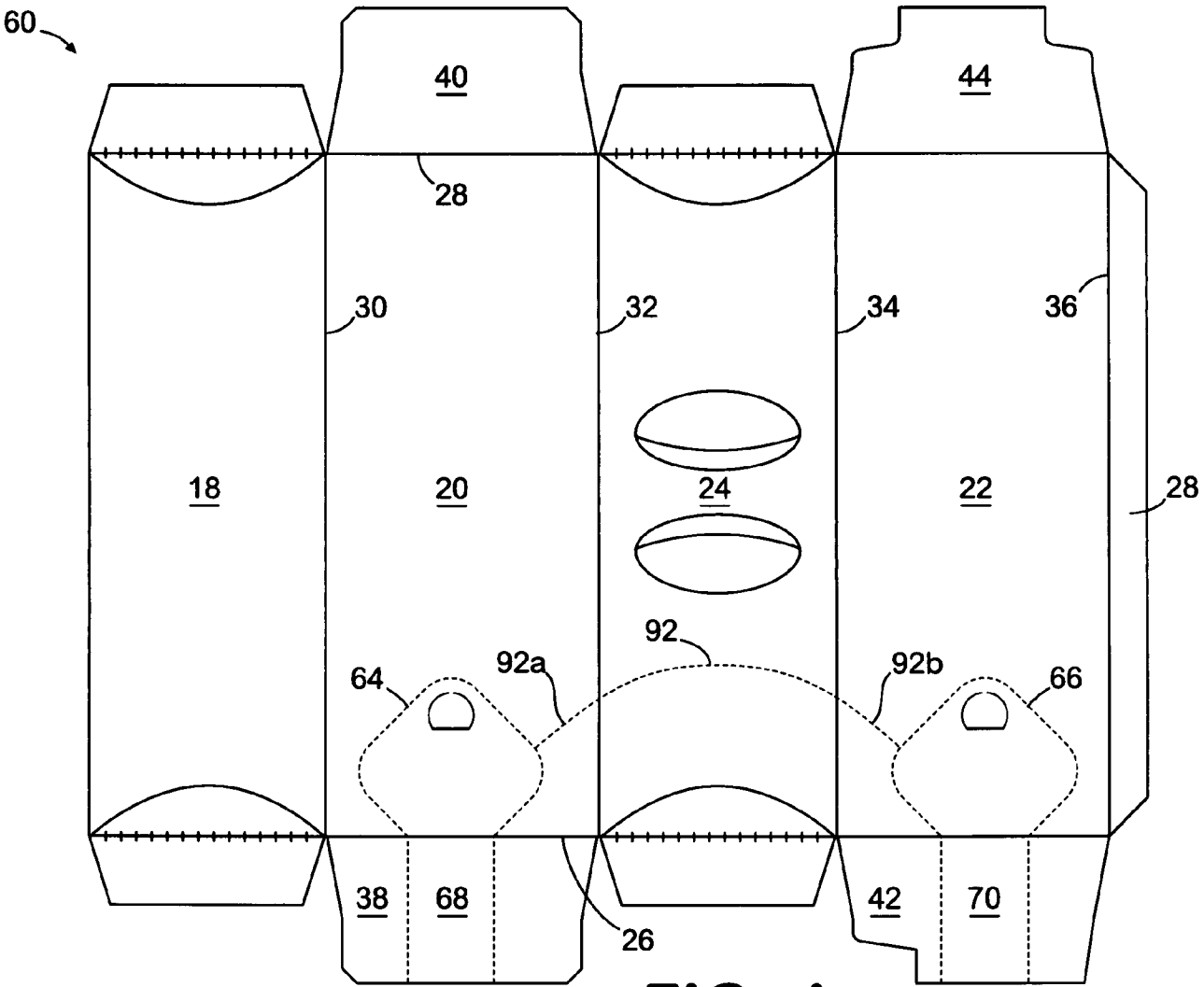
FIG. 4 illustrates a plan view of an alternative embodiment of a blank for forming another carton of the present invention.
Figure 5:
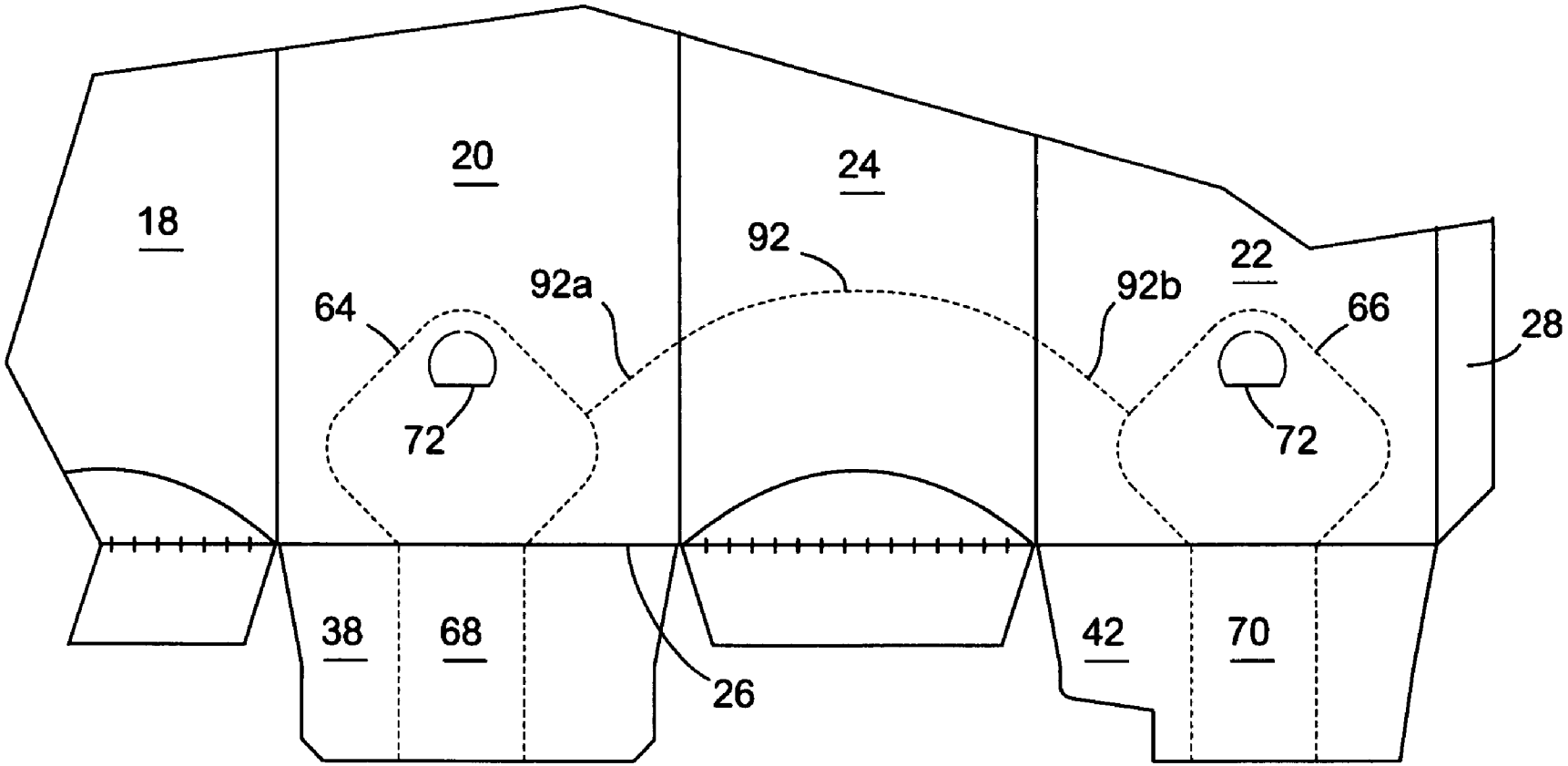
FIG. 5 is an enlarged fragmentary plan view of the blank of FIG. 4.
Figure 6:
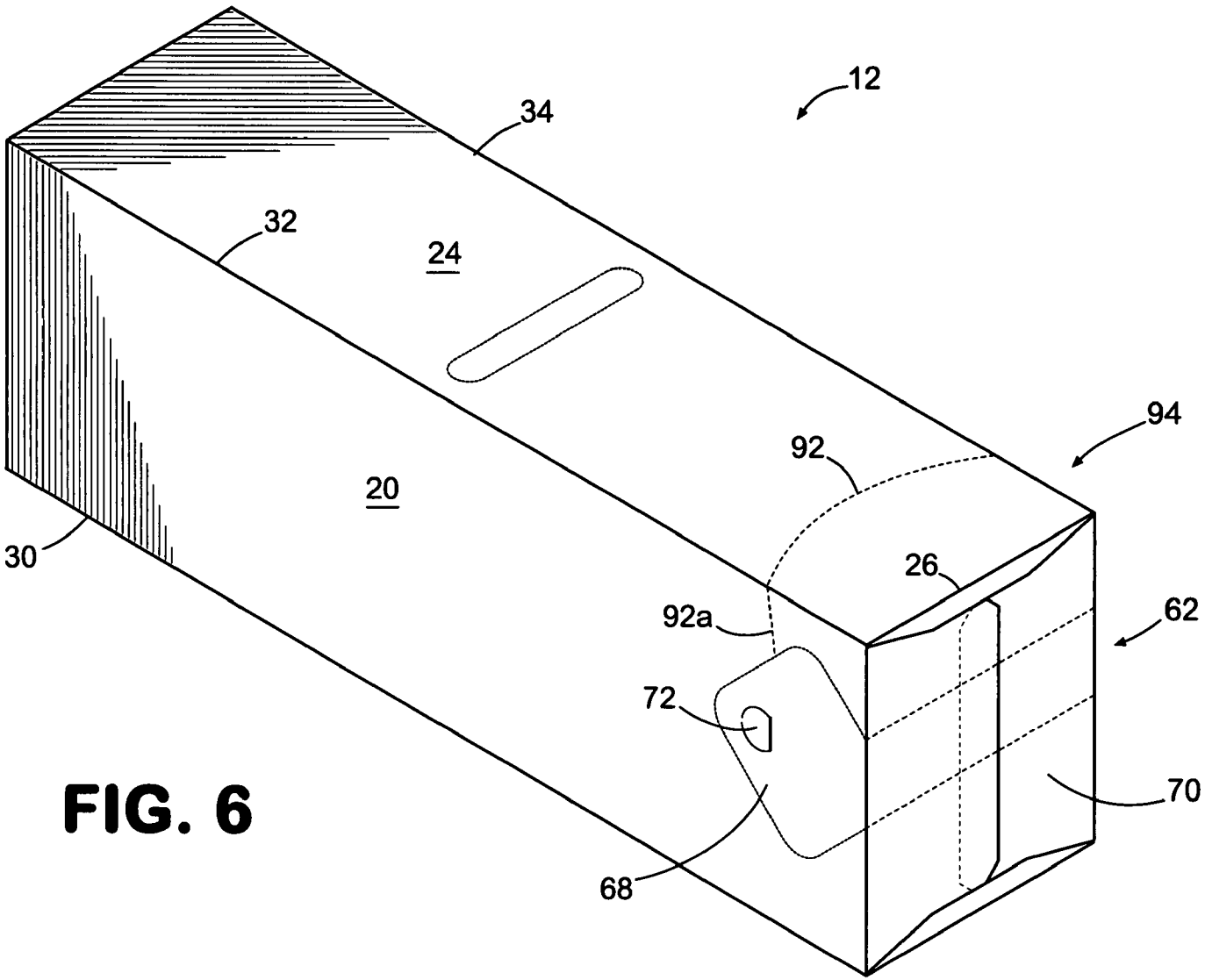
FIG. 6 is a perspective view of a carton of the present invention formed from the blank of FIG. 4.

FIGS. 4–6 illustrate an alternative embodiment of a blank 60 for forming the carton 12 having a first detachable portion 62 (FIG. 6) that is shaped differently than first detachable portion 58 described above. The blank 60 is similar to blank 16, described above, except that frangible lines 64 and 66 across the end flaps 38, 42 and the side panels 20, 22 define portions 68 and 70. Portions 68 and 70 are configured similar to one another and cooperate with one another along frangible lines 64, 66 when the end flaps 38, 42 are folded and secured to each other to define the first detachable portion 62 as shown in FIG. 6. The frangible lines 64, 66 combine to define a continuous or endless frangible line about the periphery of the first detachable portion 62 of the carton 12.

To define portions 68 and 70, the frangible lines 64 and 66 extend from the distal end of end flaps 38 and 42, respectively. Each frangible line 64 and 66 extends across fold line 26 onto the respective one of the side panels 20, 22 and then turns back around on its respective side panel to terminate on the distal end of the respective end flap from which it originated. Therefore, in the alternative embodiment, each frangible line 64, 66 is also intersected twice by fold line 26.

The portions of frangible lines 64, 66 across end flaps 38, 42 are preferably parallel to one another. Also, each of the portions 68, 70 on the side panels 20, 22 preferably is somewhat square in shape with rounded corners. Each portion 68, 70 also has a truncated portion as a result of the intersection with the fold line 26. However, each portion 68, 70 is oriented on respective side panels 20, 22 such that the curvature of a pair of opposed corners of each portion 68, 70 defined by frangible lines 64, 66 provides upper and lower peaks, relative the top and bottom of the carton 12, respectively. The upper and lower peaks promote natural tearing of the side panels 20, 22, when the endmost article from the upper tier is removed from the carton, without necessarily utilizing additional frangible segments or lines extending upward toward the top panel 24 as described below. Each of die portions 68 and 70 further preferably includes a tab 72 which may be pushed through or pulled out to initiate the removal of the detachable portion 62 from the carton 12 along frangible lines 64, 66.

Figure 7:
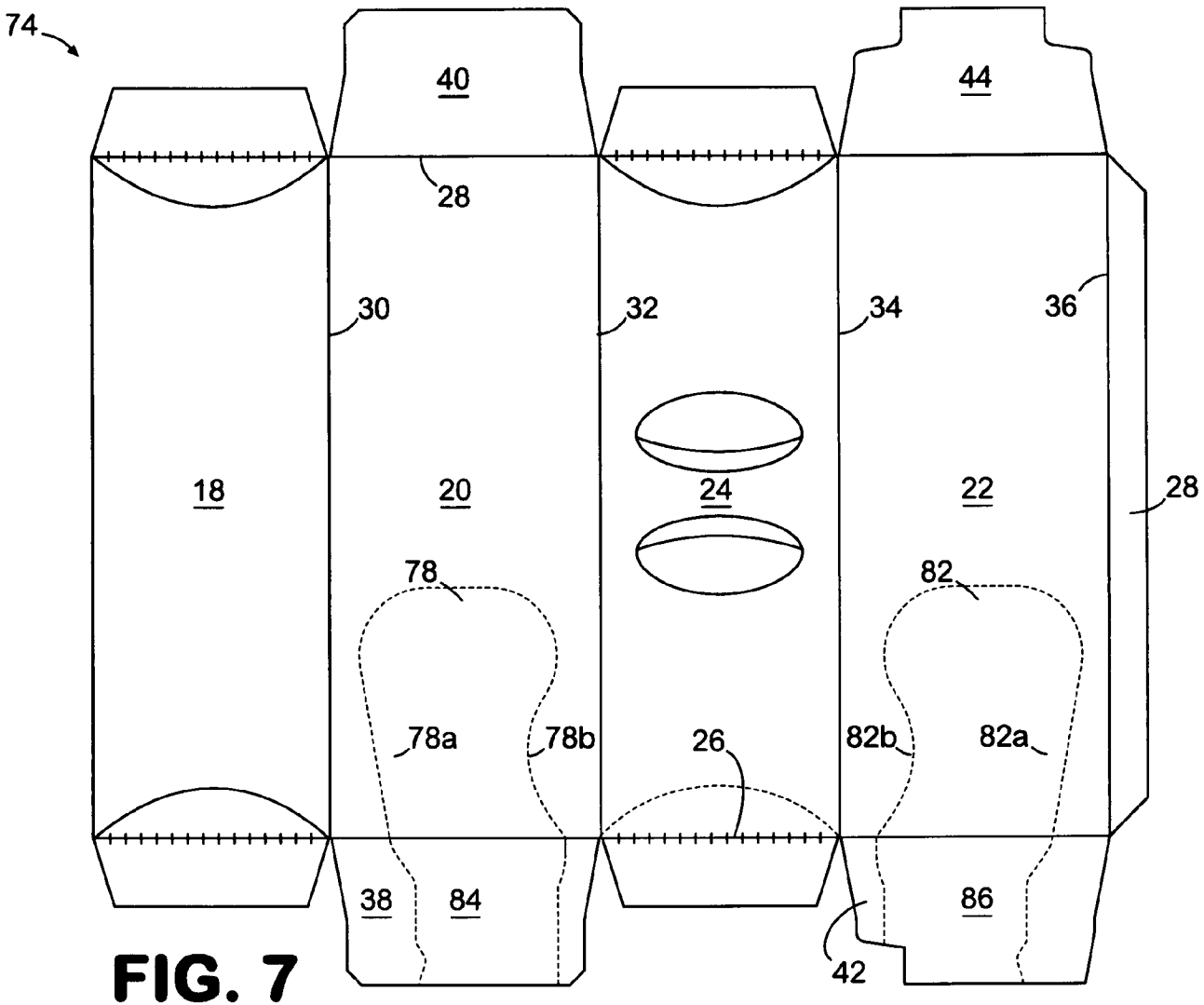
FIG. 7 illustrates a plan view or a second alternative embodiment of a blank for forming another carton of the present invention.
Figure 8:
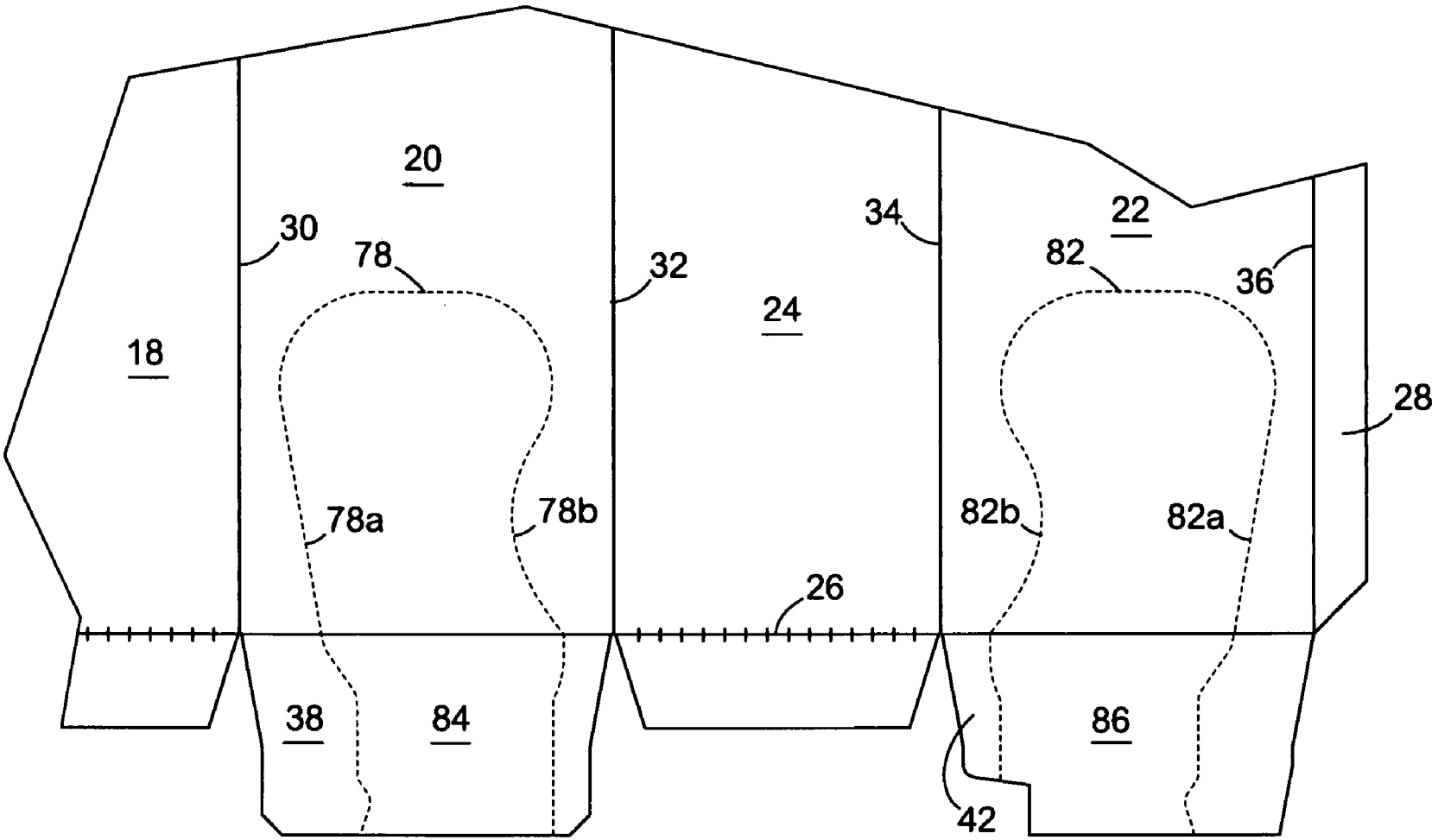
FIG. 8 is an enlarged fragmentary plan view of the blank of FIG. 7.
Figure 9:
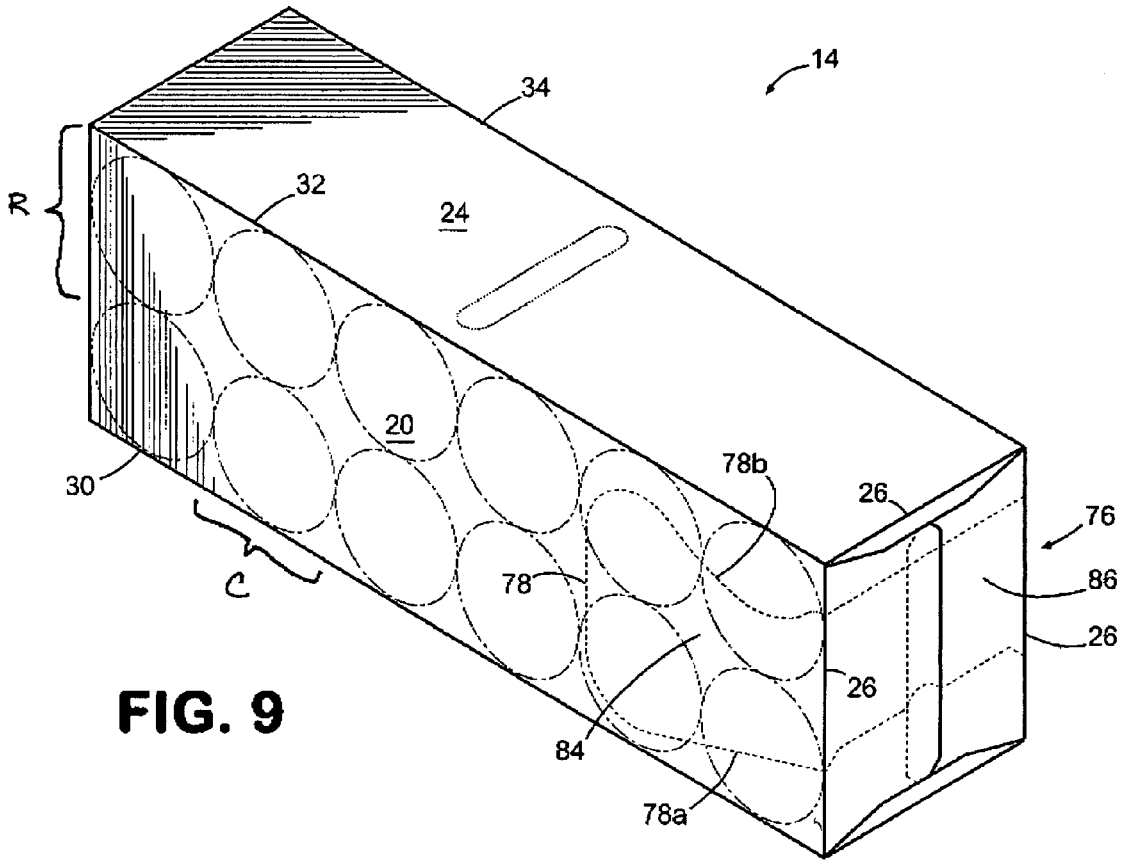
FIG. 9 is a perspective view of a carton of the present invention formed from the blank of FIG. 7.

FIGS. 7–9 illustrate a second alternative embodiment of a blank 74 for forming the carton 14 having a first detachable portion 76 (FIG. 9) that is shaped differently than either first portion 58 or 62 described above. Blank 74 includes frangible lines 78 and 82 across the end flaps 38, 42 of side panels 20, 22 to define portions 84 and 86. Portions 84 and 86 are configured similar to one another. Portions 84 and 86 cooperate with one another along frangible lines 78, 82 when the end flaps 38, 42 are folded and secured to each other to define the first detachable portion 76 as shown in FIG. 9. The frangible lines 78, 82 combine to define a continuous or endless frangible line about the periphery of the first detachable portion 76 of the carton 14.

To define portions 84 and 86, the frangible lines 78 and 82 extend from the distal end of end flaps 38 and 42, respectively. Each frangible line 78 and 82 extends across fold line 26 onto the respective one of the side panels 20, 22 and then turns back around on its respective side panel to terminate on the distal end of the respective end flap from which it originated. Therefore, each frangible line 78, 82 is intersected twice by fold line 26.

As best shown in FIGS. 7 and 8, segments 78*a* and 82*a* of frangible lines 78 and 82, extend inward on side panels 20, 22 from the fold line 26 toward the fold lines 30 and 36, respectively, so that the distance between the segments 78*a* and 82*a* of the frangible lines 78, 82 and the fold lines 30, 36 narrows as the distance from the fold line 26 increases. Also, segments 78*b* and 82*b* of the frangible lines 78 and 82, extending inward from the fold line 26 and adjacent the fold lines 32 and 34, are arched somewhat away from the fold lines 32 and 34. However, the portions of the segments 78*b* and 82*b* approximately furthest from the fold line 26 turn back toward the fold lines 32 and 34 to define an upper peak in close proximity to the top panel 24 to facilitate natural tearing of the side panels 20 and 22 when the endmost article from the upper tier is removed from the carton, without necessarily utilizing additional frangible, segments or lines extending upward toward the top panel 24.

Figure 10:
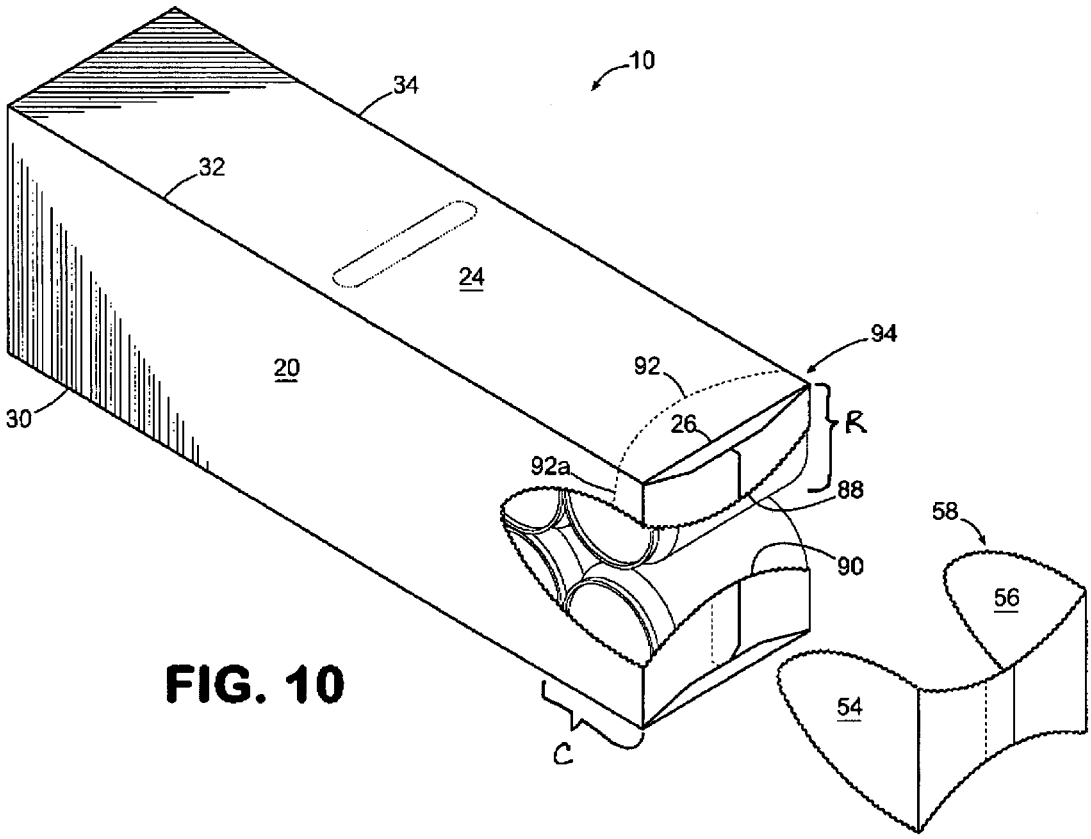
FIG. 10 is a perspective view of the carton of FIG. 3 with a portion thereof detached therefrom to define an opening for dispensing articles from the carton.

Partial or complete removal of first displaceable portions 58, 62 and 74 from the cartons 10, 12 and 14 defines an opening for dispensing articles. For example, as shown in FIG. 10, the endmost article of the upper or lower row of articles may be removed through the opening defined by removal of first detachable portion 58. The article is prevented from accidentally rolling out of the carton 10 through the opening by the upper edge 88 and lower edge 90. The lower edge 90 is formed by remaining portions of end flaps 38 and 42 alter the removal of first displaceable portion 58. The opening is also defined by upper edge 88 which restrains the upper row of articles within the carton as shown in FIG. 10. The upper edge 88 is also formed by remaining portions of end flaps 38 and 42 after removal of first displaceable portion 58.

As best shown in FIGS. 2 and 5, each carton 10 and 12 also includes a frangible line 92 extending between each side panel 20, 22 across top panel 24. However, cartons 10 and 12 of the present invention may instead be formed without the frangible line 92 as is carton 14 shown in FIG. 9. Also, carton 14 may instead be formed with frangible line 92 as are cartons 10 and 12.

When including the frangible line 92, the frangible line 92 on top panel 24 is displaced from the exit end of the cartons 10, 12. The frangible line 92 terminates at the first detachable portion 58 or 62 on side panels 20, 22 to partially define a second detachable portion 94 which borders above first detachable portion 58 or 62. The second detachable portion 94 therefore includes the upper edge 88 as shown in FIG. 10 for retaining the endmost article in the upper row of the carton.

Figure 11:
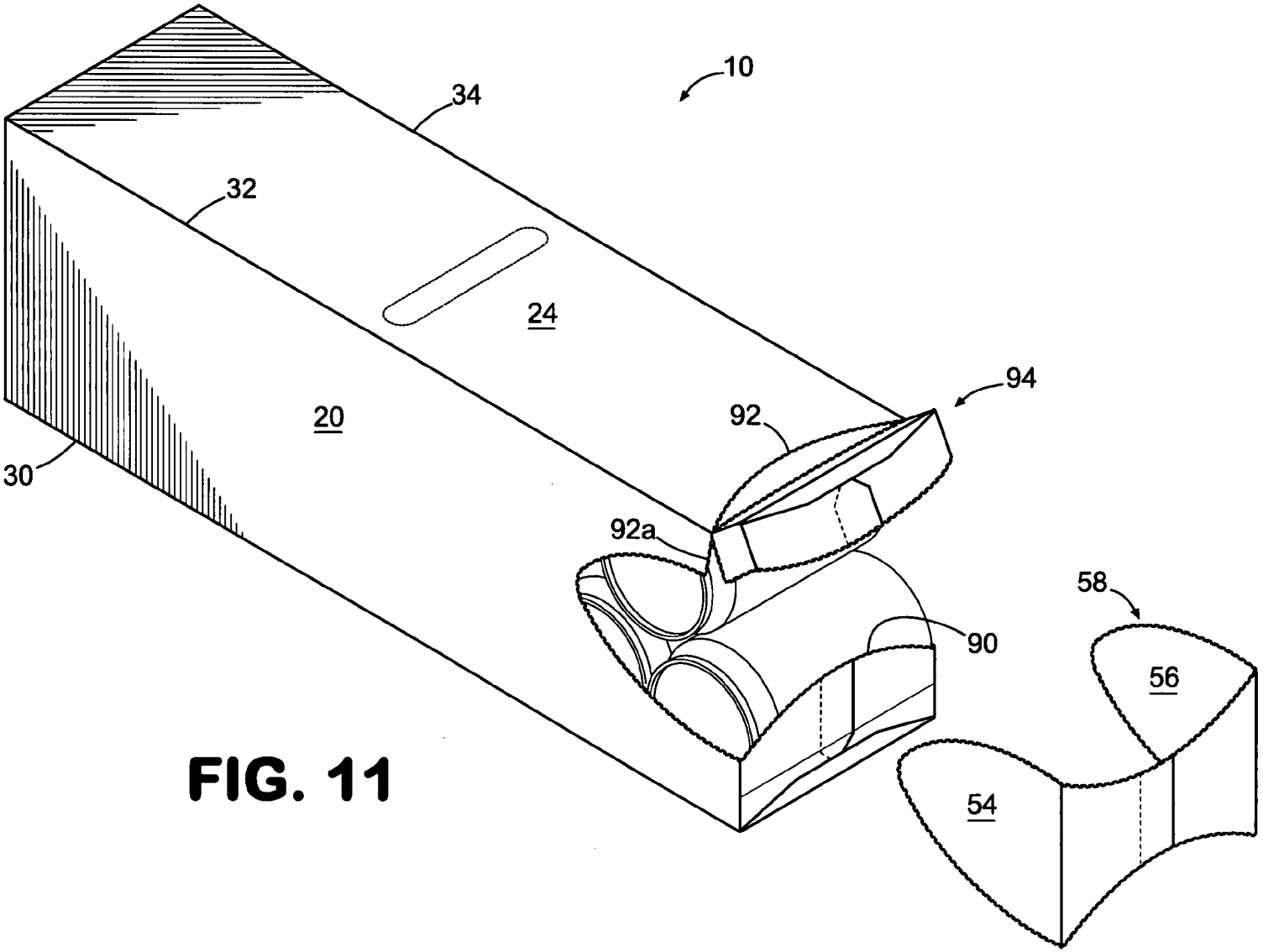
FIG. 11 is a perspective view of the carton of FIG. 10 having a second portion partially detached from the carton to enlarge the opening for dispensing articles from the carton.
Figure 12:
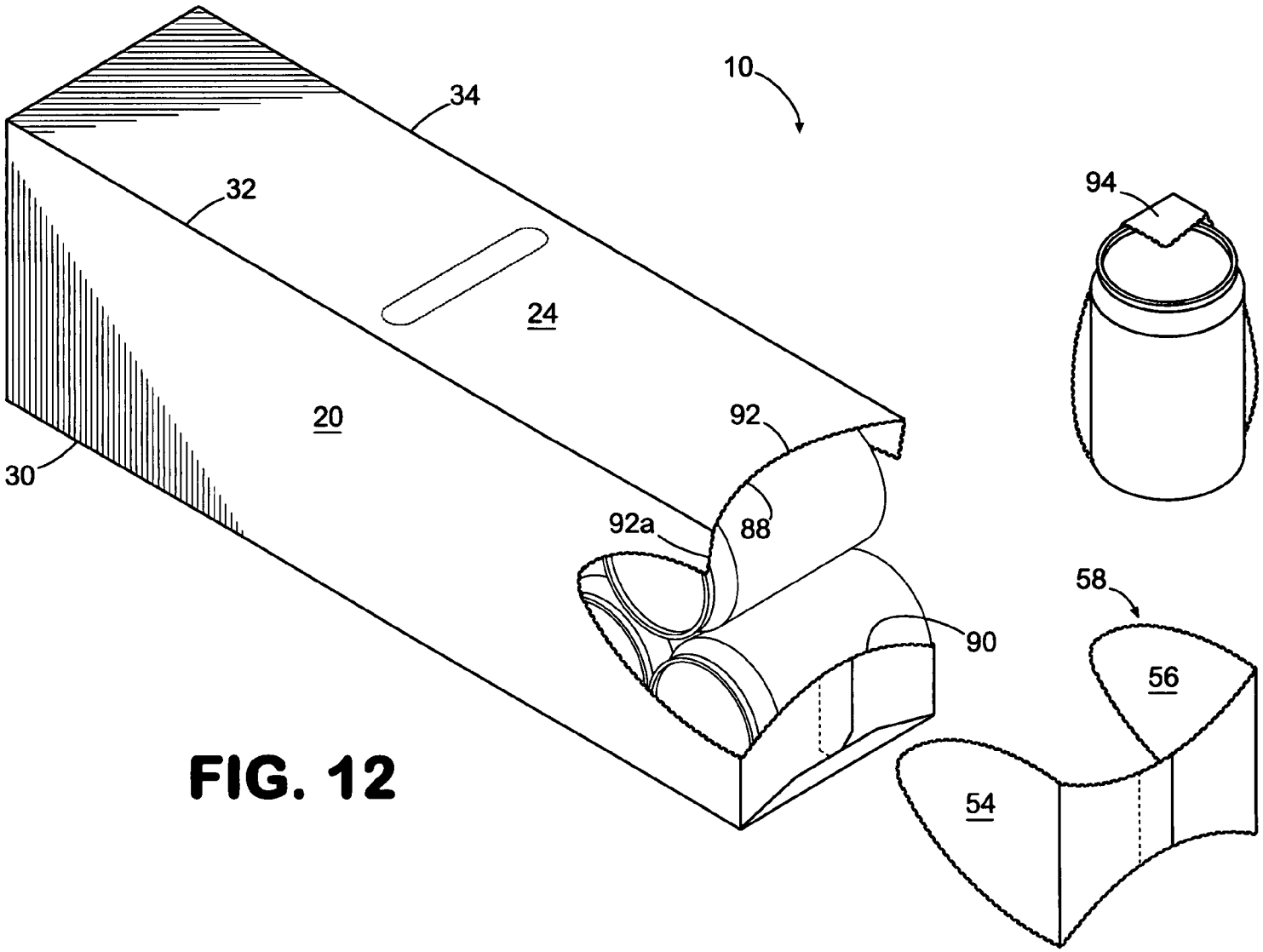
FIG. 12 is a perspective view of the carton of FIG. 11 having the second portion completely detached from the carton to redefine the opening for dispensing articles from the carton.

However, the segments 92*a*, 92*b* of the frangible line 92 on side panels 20, 22, as best shown in FIG. 2, are preferably extensively more weakened than the remainder of the frangible line 92 on top panel 24 to allow easier separation of the second detachable portion 94 from the side panels 20, 22. The second detachable portion 94 may therefore be at least partially detached from the carton with the remainder of the frangible line 92 remaining untorn across the top panel 24 to create a hinge. The second detachable portion 94 may be pivoted upward as shown in FIG. 11 to enlarge the opening to facilitate removal of the endmost article in the upper row from the carton. However, the second detachable portion 94, when pivoted back to the initial position, can yet restrain the remaining articles in the upper row. Alternatively, as shown in FIG. 12, the second detachable portion 94 may also be completely removed from the carton to enlarge the opening for dispensing articles. In either case, the opening for dispensing articles would then be defined between lower edge 90 and the upper edge 88 (FIG. 12) now across the top panel 24 after separation along frangible line 92. The opening defined by detaching the first detachable portion 58 or 62 and the second detachable portion 94 is configured to permit the endmost articles from both the upper and lower rows to be removed substantially simultaneously from the end of the carton.

The present invention has been illustrated in relation to a particular embodiment which is intended in all respects to be illustrative rather than restrictive. Those skilled in the art will recognize that the present invention is capable of many modifications and variations without departing from the scope of the invention. Accordingly, the scope of the present invention is described by the claims appended hereto and supported by the foregoing.

The invention claimed is:

1. A package, comprising:

a plurality of substantially cylindrical articles disposed on sides thereof in a plurality of rows, wherein the endmost article in each of said plurality of rows defines an endmost column of articles and the articles adjacent to said endmost column of articles define a second endmost column of articles; and a carton enclosing said articles, the carton comprising:

a first wall extending along ends of said articles in each of said rows;

a second wall hingedly connected to said first wall and extending along the sides of the articles in said endmost column; and at least one detachable portion detachably formed at least in part from said first wall and at least in part from said second wall, said at least one detachable portion to be detached from said carton to define an opening that extends along said first wall, said opening along said first wall exposing:

no more than a portion of one end of each of two said articles disposed in the endmost column, and a space defined between said two articles in said the endmost column and two said articles disposed in said the second endmost column, said space being defined by said articles in two adjacent said rows.

2. The package of claim 1, wherein said plurality of rows consists of an upper row and a lower row.

3. The package of claim 1, wherein said opening extends entirely across said second wall.

4. The package of claim 3, wherein:

said carton further comprises a third wall hingedly connected to said second wall; and said at least one detachable portion is further formed at least in part from said third wall such that said opening extends entirely across said second wall and along said third wall.

5. The package of claim 4, wherein said opening along said third wall further exposes no more than a portion of the opposite end of each of said two articles in said endmost column.

6. A package, comprising:

a plurality of substantially cylindrical articles disposed on sides thereof in a plurality of rows; and a carton enclosing said articles, the carton comprising:

a first wall extending along ends of said articles in each of said rows;

a second wall hingedly connected to said first wall and extending along the sides of the endmost articles in each of said rows;

a severance line, comprising:

an upper segment and a lower segment in said second wall; and a connecting segment in said first wall, said connecting segment interconnecting said upper segment and said lower segment;

wherein:

the endmost article in each of said plurality of rows is in an endmost column of articles;

the articles adjacent to said endmost column of articles are in a second endmost column of articles; and said connecting segment defines an opening that extends along said first wall, said opening exposing a space between two said articles disposed in said endmost column and two said articles disposed in said second endmost column, said space also being defined by said articles that are in two adjacent said rows.

7. The package of claim 6, wherein said plurality of rows consists of an upper row and a lower row.

8. The package of claim 6, wherein the maximum distance between said connecting segment in said first wall and the hinged connection between said first wall and said second wall is less than the twice the diameter of one of said articles.

9. The package of claim 6, wherein said opening further exposes no more than a portion of one said end of each of two said articles in the endmost column.

* * * * *